US011174650B2

(12) United States Patent
Schlett et al.

(10) Patent No.: US 11,174,650 B2
(45) Date of Patent: Nov. 16, 2021

(54) CLIMBING DEVICE FOR LOWERING A CLIMBING RAIL, AND METHOD FOR LOWERING A CLIMBING RAIL

(71) Applicant: Peri AG, Weissenhorn (DE)

(72) Inventors: Felix Schlett, Ulm (DE); Tobias Kolb, Altenstadt (DE)

(73) Assignee: Peri AG, Weissenhorn (DE)

( * ) Notice: Subject to any disclaimer, the term of this patent is extended or adjusted under 35 U.S.C. 154(b) by 0 days.

(21) Appl. No.: 16/485,778

(22) PCT Filed: Feb. 12, 2018

(86) PCT No.: PCT/EP2018/053394
§ 371 (c)(1),
(2) Date: Aug. 13, 2019

(87) PCT Pub. No.: WO2018/146294
PCT Pub. Date: Aug. 16, 2018

(65) Prior Publication Data

US 2020/0048918 A1 Feb. 13, 2020

(30) Foreign Application Priority Data

Feb. 13, 2017 (DE) ..... 10 2017 202 264.7

(51) Int. Cl.
*E04G 11/28* (2006.01)
*E04G 11/24* (2006.01)

(52) U.S. Cl.
CPC ..... *E04G 11/28* (2013.01); *E04G 11/24* (2013.01)

(58) Field of Classification Search
CPC ..... E04G 11/28; E04G 11/24
USPC ..... 425/63, 65; 249/20, 22; 264/32, 33
See application file for complete search history.

(56) References Cited

U.S. PATENT DOCUMENTS

| | | | | |
|---|---|---|---|---|
| 8,413,949 | B2 * | 4/2013 | Schwoerer | E04G 11/28 249/18 |
| 8,714,512 | B2 * | 5/2014 | Schwoerer | E04G 11/28 249/20 |
| 2008/0257644 | A1 * | 10/2008 | Schwoerer | E04G 11/24 182/142 |
| 2009/0146041 | A1 | 6/2009 | Schwoerer | |

(Continued)

FOREIGN PATENT DOCUMENTS

| | | |
|---|---|---|
| DE | 102005030333 | 1/2007 |
| DE | 102005030335 | 1/2007 |
| EP | 2995749 | 3/2016 |

(Continued)

*Primary Examiner* — Michael Safavi
(74) *Attorney, Agent, or Firm* — Loginov & Associates, PLLC; William A. Loginov

(57) ABSTRACT

A method and a climbing device for lowering a climbing rail, i.e. for climbing downwards. The climbing rail, which is placed on a climbing head by means of an upper protrusion, is lowered in that a climbing cylinder is retracted. The climbing cylinder can be spaced from the climbing rail by completely retracting the climbing cylinder at the upper end by means of a distancing device prior to extending the climbing cylinder again. Thus, the climbing cylinder can be extended again without the climbing rail engaging or hooking below the climbing head at the now central protrusion in that the distancing device moves the climbing head around the central protrusion.

26 Claims, 11 Drawing Sheets

(56) References Cited

U.S. PATENT DOCUMENTS

2009/0173574 A1* 7/2009 Hobmeier ..... E04G 11/28
182/82

FOREIGN PATENT DOCUMENTS

| | | |
|---|---|---|
| GB | 2533142 | 6/2016 |
| WO | 2007141264 | 12/2007 |

* cited by examiner

CLIMBING DEVICE FOR LOWERING A CLIMBING RAIL, AND METHOD FOR LOWERING A CLIMBING RAIL

FIELD OF THE INVENTION

The invention relates to a climbing device for lowering a climbing rail, the climbing device comprising the following:

a) a climbing cylinder, which can be supported at the lower end on an anchoring point, in particular on a climbing shoe, b) a climbing head, which is arranged or formed on the upper end of the climbing cylinder, it being possible for an upper projection of the climbing rail to be supported on the climbing head.

The invention further relates to a method for making a climbing rail climb downwards, i.e. lowering said climbing rail.

BACKGROUND OF THE INVENTION

It is known to use climbing devices comprising a climbing cylinder to move a climbing rail upwards. In this case, climbing formwork for constructing a building can be arranged on the climbing rail. A climbing device of this type has for example become known by the applicant's product name "RCS." This known climbing device is designed for gradually raising the climbing rail. To do this, the climbing head engages under an upper projection of the climbing rail. The climbing cylinder extends and therefore pushes the climbing rail upwards. In other applications, e.g. when demolishing a tall building, the climbing device needs to be lowered. To lower the climbing rail as required, this known climbing device has to be operated manually in a comparatively complex manner.

SUMMARY OF THE INVENTION

The problem addressed by the present invention is therefore to provide a climbing device and a method for lowering a climbing rail that make it significantly easier to lower the climbing rail in a structurally simple manner.

This problem is solved according to the invention by a climbing device and by a method.

According to the invention, a climbing device is thus provided that comprises a climbing cylinder comprising a climbing head arranged or formed thereon. The climbing cylinder is designed to be supported at its lower end on an anchoring point. An anchoring point is in particular understood to be a fixed point that is positioned directly or indirectly on the solid wall. The anchoring point may be formed on the climbing shoe. In this case, the anchoring point is preferably positioned indirectly, in particular immovably, on the solid wall. Opposite the lower end of the climbing cylinder, the climbing head is designed to support a climbing rail by the climbing head being able to engage under an upper projection of the climbing rail. Here, the upper projection may be in the form of a supporting pin.

So that the climbing cylinder can extend again once the climbing rail has been lowered without the climbing rail lifting up, the climbing device comprises a spacer device. The spacer device is designed to push the climbing head far enough away from the climbing rail that the climbing cylinder can extend without the climbing head thereof becoming hooked on the climbing rail. When the climbing cylinder extends from the spacer device, the climbing head is automatically spaced from a central projection of the climbing rail. Here, the central projection may be in the form of a supporting pin. The spacer device is activated when the climbing cylinder is retracted, in particular fully retracted, such that the climbing head bypasses the central projection when it is extending. When the climbing cylinder is extended, the spacer device is deactivated, such that the climbing head can engage under the upper projection. This makes it significantly easier to handle the climbing device, since the climbing head does not need to be moved away from the climbing rail manually. The climbing rail can instead be lowered by a user who is remote from the climbing cylinder.

In the context of the present invention, the terms "upper," "lower" and the like relate to the climbing device when assembled.

The spacer device is preferably activated when the climbing cylinder is extended by less than 20%, in particular less than 10%, preferably less than 5%. The spacer device is preferably deactivated when the climbing cylinder is extended by more than 30%, in particular more than 50%, preferably more than 70%.

More preferably, the spacer device is designed to move the climbing head away from the climbing rail even when retracting the climbing cylinder, and is in particular designed to push the climbing head away from the climbing rail. As a result, the spacer device is actuated by retracting the climbing cylinder. In other words, the climbing head is automatically spaced from the central projection of the climbing rail by the spacer device when the climbing head is lowered.

Preferably, the spacer device is designed to be activated by the climbing cylinder being fully retracted, in order to move the climbing head away from a projection when the climbing cylinder is subsequently extended.

A climbing device platform may be arranged on the climbing rail. In particular, a protective wall may be arranged on the climbing rail to protect workers from falling and from any falling debris when demolishing a building. The climbing formwork is preferably provided for concreting a building wall on which the climbing device can be raised and/or lowered.

The spacer device may be arranged or formed on the climbing cylinder, for example at the lower end of the climbing cylinder. Preferably, however, the spacer device is arranged on the climbing head. This results in a particularly compact design of the climbing device.

The climbing head can be reversibly detachably arranged on the climbing cylinder, i.e. can mounted and detached without being destroyed. As a result, only the climbing head needs to be changed to switch from a climbing device for raising the climbing rail to a climbing device according to the invention for lowering the climbing rail.

The spacer device may comprise a lever arm that is designed to be supported on the central projection when extending the climbing cylinder and to urge the climbing head from the central projection when extending the climbing cylinder further. The spacer device may comprise a protrusion that is supported on the upper face of the climbing cylinder when the climbing cylinder is retracted, in order to pivot the lever arm when the climbing cylinder is retracted and to thus change the spacer device from the deactivated state to the activated state.

The spacer device, in particular the lever arm of the spacer device, may be designed such that surface pressure prevents the spacer device moving back from the activated state into the deactivated state provided that the spacer device is in contact with the central projection, in particular provided that a rotational axis of the spacer device is below the central projection.

Alternatively or additionally, the spacer device, in particular the lever arm of the spacer device, may comprise a tab that prevents the spacer device moving back from the activated state into the deactivated state provided that the spacer device is in contact with the central projection, in particular provided that a rotational axis of the spacer device is below the central projection.

The spacer device may comprise a pivotable rocker. The rocker may comprise the lever arm and/or the protrusion.

The rocker may have an outer end, it being possible for the outer end to be pushed away from the climbing rail, in particular from the central projection of the climbing rail. In this case, the rocker may be designed such that, when being pushed away, it pivots from an inwardly pivoted position of the outer end into an outwardly pivoted position of the outer end.

The rocker preferably comprises two brackets. The brackets may be in mirror symmetry to a plane of symmetry extending along the longitudinal axis of the climbing cylinder.

The rocker may have an inner end, which is opposite the outer end. The inner end may be in the form of a protrusion. The rocker may be designed such that the inner end comes to rest on the upper face of the climbing cylinder when the climbing cylinder is being retracted, such that the outer end of the rocker is pivoted into the outwardly pivoted position and the outer end can be pushed away from the climbing rail, in particular from the central projection of the climbing rail. In other words, the rocker is preferably actuated by the inner end of the rocker running onto the upper end of the climbing cylinder tube. The result is that, in a particularly structurally simple manner, actuation, i.e. activation of the spacer device, only takes place when the climbing cylinder is virtually fully retracted. The actuation of the rocker ensures that the rocker is in the correct position when the climbing cylinder is extended again.

The spacer device may be designed such that it is held in the deactivated, in particular inwardly pivoted, position solely by gravity. In order to reliably ensure the function of the spacer device, however, the spacer device preferably comprises a spring element designed to hold the spacer device in the deactivated, in particular inwardly pivoted, position.

In a particularly preferred embodiment of the invention, the climbing device comprises a climbing shoe, which can be mounted on a solid wall on one side and is designed to guide the climbing rail on the second side, which is opposite the first side. Said rail may be guided by arms of the climbing shoe, which are in particular pivotable. The climbing shoe comprises a detent, on which the climbing rail can be supported by a lower projection. In this case, the lower projection is preferably in the form of a supporting pin. the detent can be moved from a retracted position into an extended position. By contrast with the retracted position, the lower projection may be supported on the detent in the extended position.

The climbing shoe may comprise a blocking device, which is designed to block the detent from extending.

In addition, the climbing device may comprise a mechanical actuating means for actuating the blocking device. The mechanical actuating means may be longer than 1 m, in particular longer than 2 m, preferably longer than 3 m. As a result, the blocking device can be remotely controlled. A user can in particular stand on adjacent platform to lower the climbing rail.

Together with the spacer device according to the invention, the above-described design of the climbing shoe allows the climbing rail to be lowered very easily, without the climbing cylinder needing to be pivoted manually.

The design of a climbing shoe is, however, also considered to be a stand-alone invention, in particular so as to be separate from the spacer device.

The climbing cylinder is preferably arranged, at its lower end, to be pivotable on the climbing shoe. It is arranged in this case such that it is preferably reversibly detachable in order to make it possible to rapidly mount the climbing cylinder on the climbing shoe and detach said cylinder from said shoe. The climbing cylinder can be pretensioned towards the climbing rail, i.e. away from the solid wall, by a climbing-cylinder spring element of the climbing device. In this case, the climbing-cylinder spring element is preferably arranged or formed on the climbing cylinder. The climbing-cylinder spring element may be supported at one end on the climbing shoe. The climbing cylinder is constantly pressed towards the climbing rail by the climbing-cylinder spring element and is preferably only spaced from the climbing rail by the spacer device against the spring force of the climbing-cylinder spring element.

The mechanical actuating means may be pressure-actuated, in particular in the form of a bar or the like. In order to make it possible to handle the mechanical actuating means easily and in a compact manner, the mechanical actuating means can preferably solely be traction-actuated, in particular in the form of a chain or the like. Particularly preferably, the mechanical actuating means is in the form of at least one cable. More preferably, the mechanical actuating means is in the form of a plurality of cables, in particular in the form of two cables.

In another embodiment of the invention, the climbing shoe may comprise a tongue and a deflecting portion. The climbing shoe may be designed such that tongue retracts when the detent extends and the detent retracts when the tongue extends.

the detent is preferably designed such that it extends in a spring-loaded manner. a detent spring element thus moves the detent into the extended position when the detent is not being prevented from extending. Alternatively, the detent may be designed such it retracts in a spring-loaded manner. the detent spring element thus moves the detent into the retracted position when the detent is not being prevented from retracting. The climbing shoe is preferably designed to adjust or change the direction of action of the detent spring element. In other words, the climbing shoe may be designed such that the detent spring element adjusts such that the detent either extends in a spring-loaded manner or retracts in a spring-loaded manner.

In addition, the climbing device may comprise a blocking device, which is designed to block the movement of the tongue. The blocking device may have a blocking position, in which the detent is blocked from extending, and a released position, in which the detent can extend. The blocking device is preferably held in both the blocking position and the released position by the detent spring element.

More preferably, a first above-mentioned cable is provided in order to move the blocking device into the blocking position by exerting traction on the first cable. A second above-mentioned cable may be provided in order to move the blocking device into the released position by exerting traction on the second cable. To prevent any confusion, the two cables may be different, in particular they may be different colors.

The design of the climbing device is further simplified if the blocking device is in the form of an eccentric. The eccentric can be moved by pivoting from the blocking position into the released position and back again.

In a more preferred embodiment of the invention, for unlocking the blocking device, the blocking device comprises a lever that is arranged on the climbing shoe below the contact surface of the detent for the projections of the climbing rail. The lever being actuated by a projection of the climbing rail can indirectly or directly cause the detent to extend.

In another embodiment of the invention, the blocking device comprises a toggle joint that is blocked in a compressed position when the detent is almost fully extended in order to hold the detent in the almost fully extended position. The blocking device may be designed such that the blocking of the toggle joint is released by loading when the climbing rail comes to rest on the detent (by means of a projection of the climbing rail). In so doing, the toggle can be moved into its elongated position. The lever being actuated (by a projection of the climbing rail) can block the toggle joint again. In this embodiment of the invention, the detent spring element is preferably designed such that the detent tends towards retracting due to the spring force of the detent spring element.

More preferably, an articulated arm of the toggle joint may comprise a slot for guiding a blocking projection of an additional articulated arm of the toggle joint. A movement of the blocking projection in the slot then moves the toggle joint from its compressed position into its elongated position.

In a particularly structurally simple embodiment of the climbing shoe, an articulated arm of the toggle joint is in the form of a rocker. The rocker may comprise the lever on one side and an articulated arm of the toggle joint on the other side.

An articulated arm of the toggle joint may be arranged on the climbing shoe so as to be spring-loaded or so as to deviate from the vertical. This urges the articulated arm to move into the released position of the toggle joint when the detent is fully extended.

In a more preferable embodiment of the invention, the blocking device comprises a push-push mechanism that is indirectly or directly connected to the detent and holds the detent in the almost fully retracted position during the first retraction, and the push-push mechanism releases the locking of the blocking device when the detent is actuated again, in particular by the lever, into the fully retracted position, such that the detent can extend. A push-push mechanism is also known as a "ballpoint pen mechanism", i.e. a mechanism that latches with a first actuation and unlatches with a second actuation in the same direction.

More preferably, the blocking device comprises a spring-loaded freewheel for the lever, such that actuation of the lever downwards is not transmitted to the detent, but actuation upwards is. As a result, the climbing rail can be lowered as far downwards as necessary without the projections that actuate the lever causing the detent to move. If, however, the climbing rail is raised by a small amount such that a projection of the climbing rail actuates the lever in the opposite direction, this causes the detent to move.

The climbing device may comprise the climbing rail. The climbing rail may be guided by the climbing shoe. The climbing rail may comprise an upper projection, a central projection and/or a lower projection. The projections may be identical, in particular in the form of supporting pins. Preferably, the climbing rail also comprises a plurality of projections that are evenly spaced apart in the longitudinal direction of the climbing rail.

The problem according to the invention is also solved by a method for lowering a climbing rail, in particular using a climbing device as described above, wherein the method comprises the following method step:

B) extending the climbing cylinder and thereby moving the climbing head away from the climbing rail, in particular by means of the activated spacer device.

The climbing head is preferably moved away, in particular pushed away, by the lever arm of the spacer device. When the climbing cylinder is extended so as to point diagonally upwards, the lever arm can come to rest on the central projection. When the climbing cylinder is extended further, the lever arm can space the climbing head from the central projection by means of a pivoting movement.

Preferably, the method comprises the following method steps:

A) positioning the climbing rail on the detent of the climbing shoe by means of its lower projection;

B) extending the climbing cylinder, the climbing head passing the central projection, in particular by means of the activated spacer device;

C) deactivating the spacer device and raising the climbing rail once the climbing head has engaged under an upper projection of the climbing rail;

D) retracting the detent;

E) retracting the climbing cylinder and thereby lowering the climbing rail, which is positioned on the climbing head here;

F) extending the detent and positioning the climbing rail on the detent by means of its central, now lower projection.

The retraction of the detent in method step D) and/or the extension of the detent in method step F) is particularly preferably carried out by actuating the actuating means.

In a separate aspect of the invention, the detent is preferably extended by actuating the lever from a projection of the climbing rail.

In another separate aspect of the invention, the detent is held in the almost fully extended position by the toggle joint or the toggle mechanism. Lowering the climbing rail onto the detent preferably releases the blocking of the blocking device.

In another embodiment of a method, the detent is held in the almost fully retracted position during retraction by the push-push mechanism. Actuating the detent again by means of the lever then releases the blocking of the push-push mechanism and fully extends the detent.

The climbing shoes described in the context of the present invention may be in the form of a wall climbing shoe and/or a ceiling climbing shoe. Alternatively or additionally, the climbing shoes may be divided into parts, and may comprise a wall shoe part that can be fastened to the wall (or a ceiling shoe part that can be fastened to the ceiling) and a rail-guide part for guiding the climbing rail. The rail-guide part and the wall shoe part or ceiling shoe part may be connected by means of an in particular horizontal slide-in shaft of the climbing shoe.

The climbing rail may be formed in multiple parts. In this case, a first and a second rail part may be arranged in success when viewing in the climbing direction, it being possible for the first and the second rail part to each be guided and held by means of one of the climbing shoes, and an actuator being designed to either increase or reduce the distance between the first and the second rail part in the climbing direction. Therefore, the actuator can be supported on a climbing shoe by means of the second rail part. It can slide the first rail part away from the second rail part, it being possible for the first rail part to remain guided in a climbing shoe. In other words, the actuator can move the first rail part in the climbing direction. The actuator can then further reduce the distance between the first and the second rail part. In this case, the first rail part can be held in a climbing shoe assigned thereto. The second rail part can thus now climb in the climbing direction. Then the first rail part can again be slid further in the climbing direction by means of the actuator and the second rail part can in turn be drawn along behind. Therefore, the climbing system can continuously climb. It is no longer necessary to rearrange the actuator. During the climbing process, climbing shoes are incrementally released counter to the climbing direction. These climbing shoes may be mounted in front of the first rail part in the climbing direction, such that the climbing process can be continued seamlessly or at least substantially seamlessly. The climbing system thus makes it possible to alternately use the climbing shoes as guides for a rail part and as holders for a rail part. In other words, this results in a "caterpillar" like, in particular continuous, climbing process. In comparison with known climbing systems, at least one work step in form of rearranging the actuator and/or in the form of repositioning the climbing rail is omitted. Since the climbing rail is split into at least two parts, it is also easier to transport.

Although the climbing usually takes place from the bottom of a building to the top, it is also conceivable, for example following completion of a building, to also provide a direction from top to bottom, this in particular being vertical, as a climbing direction.

It is conceivable that the climbing rail comprises a leading rail part that leads in the climbing direction and a trailing rail part that trails the leading rail part in the climbing direction. Therefore, the leading and trailing rail parts can be specially adapted. For example, the trailing rail part may comprise a trailing work platform. The trailing work platform may be set up and/or arranged such that climbing shoes that are no longer required and have already been "climbed over" can be reached by a worker, and in particular detached.

It may also be provided that the actuator is designed as or comprises a linear drive, in particular a hydraulic or pneumatic cylinder, a spindle drive, a rack and pinion drive and/or a chain drive. Therefore, the actuator as well as the first and the second rail part can be arranged in a common longitudinal direction, in particular in the climbing direction. Therefore, the climbing system can be particularly compact. In addition, a linear drive, in particular of one of the above-mentioned types, allows for a particularly consistent and/or well-controlled increase or reduction in the distance between the first and the second rail part.

It is particularly advantageous if the actuator can be remote-controlled or is designed as a remote-controlled unit. A worker can thus operate the climbing system in a remote-controlled manner. A worker can thus also particularly easily operate a plurality of similarly designed climbing systems simultaneously and/or in a staggered manner.

It is particularly advantageous if the actuator is fastened or can be fastened to the first and/or the second rail part, preferably to the trailing rail part. For example, the actuator may be designed as a hydraulic cylinder. In this case, the piston rod of the hydraulic cylinder can be fastened to the first rail part and the piston housing can be fastened to the second rail part.

It is also conceivable for the actuator to be arranged on an inner and/or outer face of the first and/or the second rail part. Therefore, various different forms of rail and/or climbing shoe can be used for the climbing system according to the invention. In addition, the positioning of the actuator may be selected such that the actuator can climb past the climbing shoe at any point in time so as to be spaced from said climbing shoe.

The climbing system can be further reinforced and/or stabilized if the first and the second rail part are guided relative to one another by means of a guide element.

The guide element may be strengthened for this purpose. For example, it may be in the form of a rail and/or may be designed as a metal sheet, in particular a profiled metal sheet, or as a tube or profiled part having a round or square cross section.

To optimally connect the guide element to the relevant rail part, the guide element may be arranged on or in the first and/or the second rail part on the inside and/or the outside. It can also partially surround the first and/or the second rail part.

It may be provided that the guide element comprises an articulated joint. Therefore, the guide element can bend, preferably in a restricted manner and/or so as to be limited to at least one degree of freedom. As a result, the climbing system can be particularly easily adapted to climbing situations in which a non-straight path is to be climbed. For example, the climbing system can thus also be designed to climb over wall projections or the like. The articulated joint can in particular be releasably secured. For example, the articulated joint can designed to be stiffened, in particular reversibly, by means of a locking pin.

Further features and advantages of the invention are found in the following detailed description of several embodiments of the invention, from the claims and with reference to the drawings, which show details that are essential to the invention. The various features can each be implemented in variants of the invention either individually or in any combination. The features shown in the drawings are laid out such that the special features according to the invention are made clearly visible.

DETAILED DESCRIPTION

Figure 10:
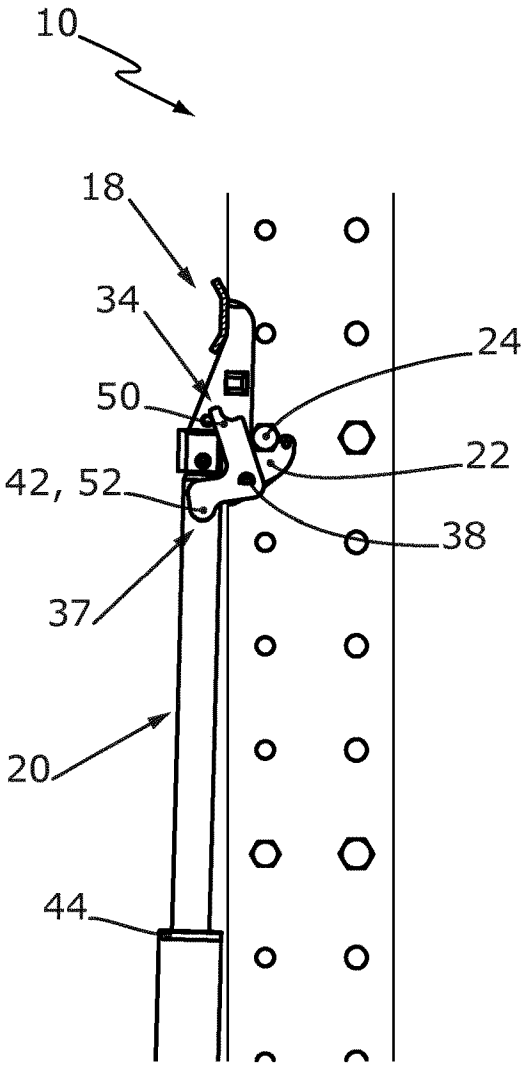
FIG. 10 is a side view of the climbing device with a fully extended climbing cylinder corresponding to FIG. 1.
Figure 12:
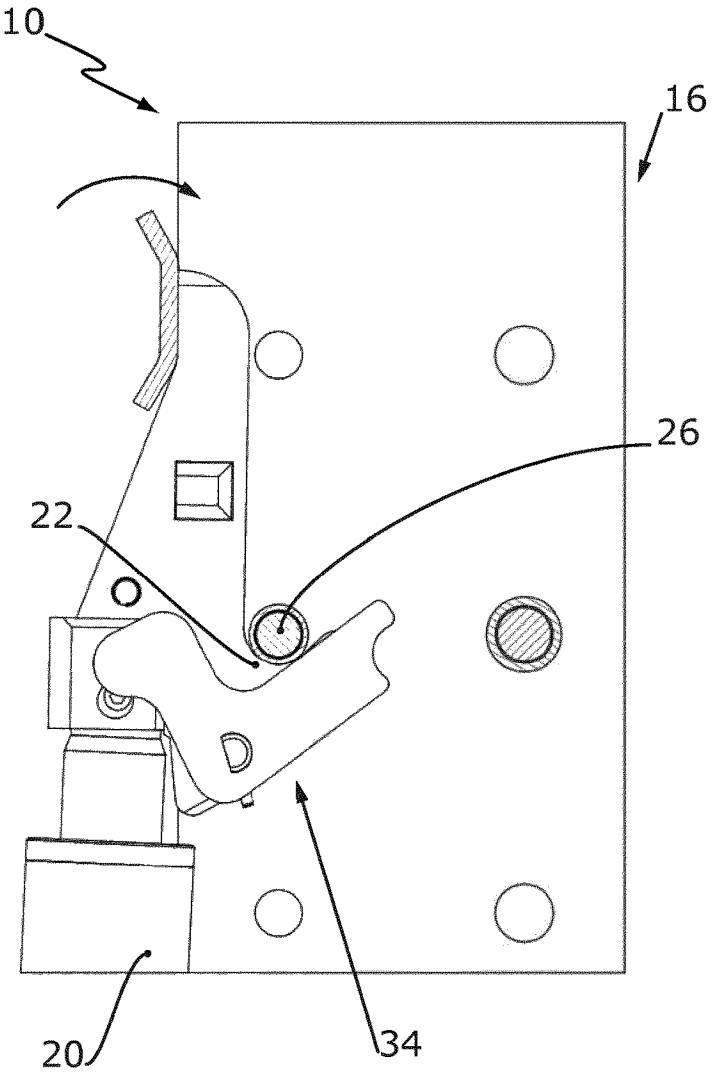
FIG. 12 is a partial side view of the climbing device in a special mode according to FIG. 11, while the climbing rail is being raised.
Figure 11:
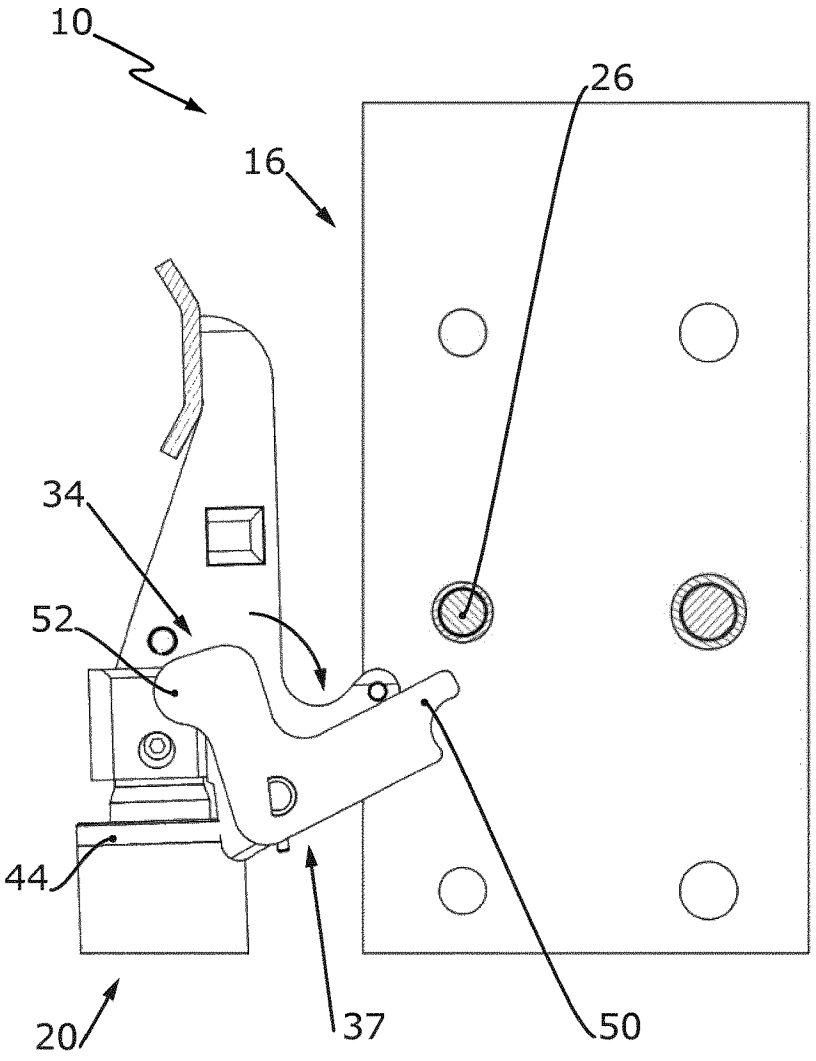
FIG. 11 is a partial side view of the climbing device in a special mode, before the climbing rail is raised.

FIGS. 1 to 10 show a climbing rail being lowered, FIGS. 11 and 12 show the climbing rail being manual raised in a special mode, and FIGS. 13 to 16 show details for actuating a climbing shoe.

Figure 1:
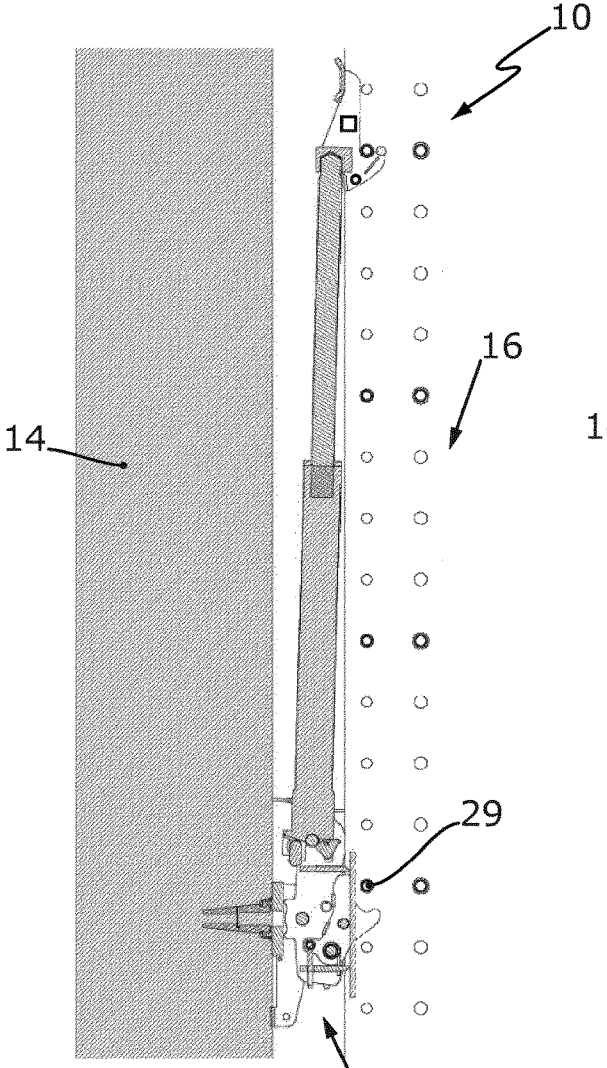
FIG. 1 is a sectional view of a climbing device with an extended climbing cylinder.

FIG. 1 shows a climbing device 10 comprising a climbing shoe 12, which is mounted on a solid wall 14. The climbing device 10 comprises a climbing rail 16. A platform and/or a protective wall (neither are shown) may be arranged or formed on the climbing rail 16.

Once the solid wall 14 has been demolished above the portion of the climbing rail 16 shown, the climbing rail 16 is intended to be lowered in a simple manner, i.e. to climb downwards.

Figure 2:
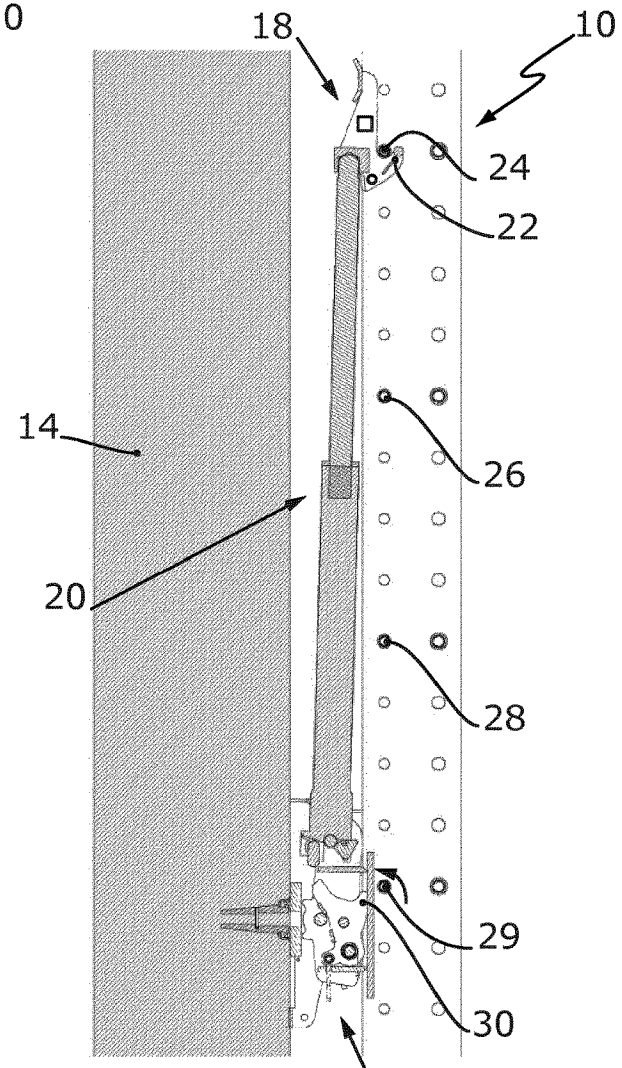
FIG. 2 is a sectional view of the climbing device according to FIG. 1 with a climbing shoe comprising a retracted detent.

FIG. 2 shows the climbing device 10, and it is clear from FIG. 2 that the weight of the climbing rail 16 is borne by a climbing head 18 that is mounted on a climbing cylinder 20. Said climbing head 18 comprises a hook 22, which engages under an upper projection 24 of the climbing rail 16. The climbing rail 16 comprises a plurality of projections, with an upper projection 24, a central projection 26, a lower projection 28 and an additional projection 29 (see also FIG. 1) being provided with a reference sign in FIG. 2. The projections 24, 26, 28, 29 are preferably identical. The projections 24, 26, 28, 29 are in particular arranged or formed so as to be equidistant from one another. The projections 24, 26, 28, 29 may each be in the form of a supporting pin. A hook-shaped detent 30 of the climbing shoe 12 is retracted to allow the climbing cylinder 20 to be retracted without the projections 24, 26, 28, 29 resting on the detent 30. During the work, the climbing rail 16 has been supported on the wall 14 by the detent 30 of the climbing shoe 12 by means of the additional projection 29. The detent 30 can only be retracted if, as shown in FIG. 2, the detent 30 is positioned so as to be free of any load, i.e. the projection 24, 26, 28, 29 has to be far enough away from the detent 30 that it can be pivoted from the extended position into the retracted position without any disturbance or contact.

Figure 3:
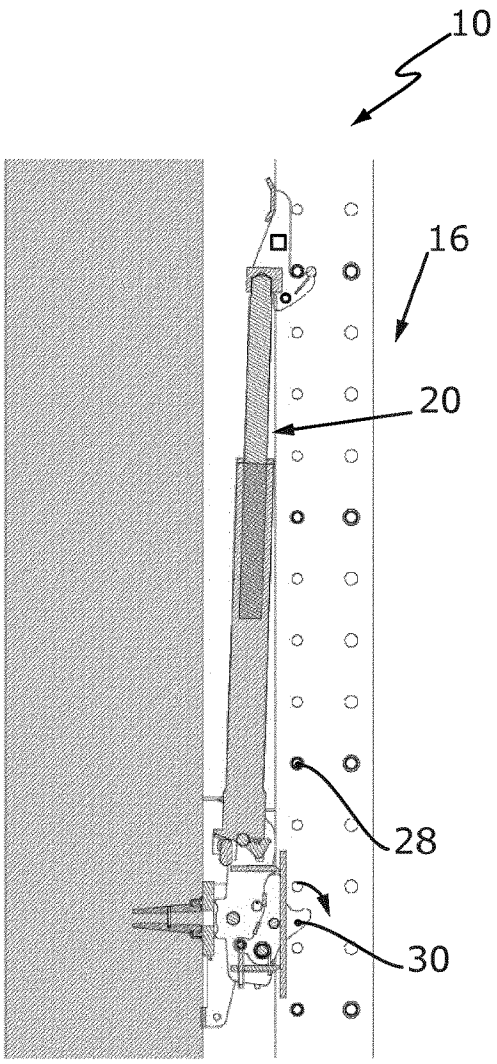
FIG. 3 is a sectional view of the climbing device according to FIG. 2 with a partially retracted climbing cylinder and an extended latch.

FIG. 3 shows the climbing device 10 with the climbing cylinder 20 partially retracted. The detent 30 has been extended such that lower projection 28 can rest on the detent 30 when the climbing cylinder 20 is retracted further and the climbing rail 16 is lowered further as a result.

Figure 4:
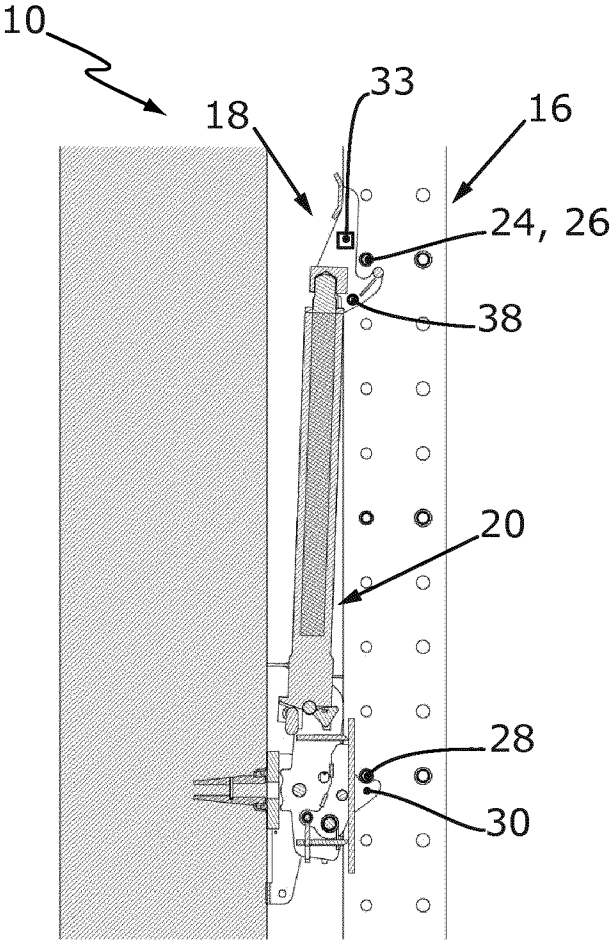
FIG. 4 is a sectional view of the climbing device according to FIG. 3 with a retracted climbing cylinder.

FIG. 4 shows the climbing device 10 with the climbing cylinder 20 retracted. The weight of the climbing rail 16 is borne by the lower projection 28 on the detent 30, such that the climbing head 18 can move transversely to the longitudinal axis of the climbing rail 16. The climbing head 18 is no longer hooked under the upper projection 24 or the now central projection 26.

Figure 5:
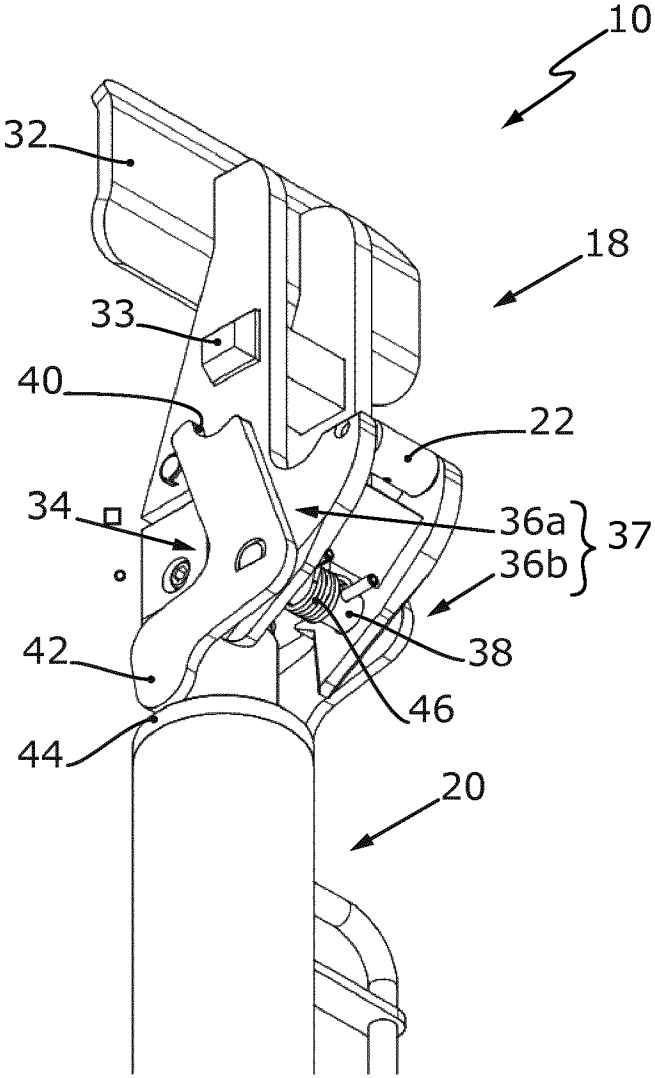
FIG. 5 is an isometric view of the upper part of the climbing cylinder with a climbing head fastened thereto and a deactivated spacer device.

FIG. 5 shows the climbing device 10 with the climbing cylinder 20 and the climbing head 18. The hook 22 for engaging under a projection 24, 26, 28, 29 (see FIG. 2) is formed on the climbing head 18. A guide portion 32, which is in the form of a metal guide sheet here, prevents the climbing head 18 from becoming inserted too deep into the climbing rail 16 (see FIG. 4). The climbing head 18 also comprises a guide piece 33 (see also FIG. 4), which centers the climbing head 18 in the climbing rail 16 (see FIG. 4), in particular by means of sloping side faces.

In order to further lower the climbing rail 16 from the position shown in FIG. 4 in a subsequent cycle, the climbing cylinder 20 has to be extended again. Here, the climbing head 18 would, however, engage under the central projection 26 (see FIG. 4) again. To prevent this, the climbing head 18 comprises a spacer device 34. The spacer device 34 comprises a first bracket 36*a* and a second bracket 36*b*, which is not fully visible in FIG. 5. The brackets 36*a*, 36*b* form a rocker 37 of the spacer device 34. The brackets 36*a*, 36*b* are identical and are arranged on a rotary pin 38 (see also FIG. 4) of the spacer device 34 for conjoint rotation. The brackets 36*a*, 36*b* are angled, i.e. they have an L-shaped basic form. The brackets 36*a*, 36*b* comprise a contact surface 40 for the projections 24, 26, 28, 29 (see FIG. 2) at one end and a protrusion 42 at the other end. The contact surface 40 is in particular in the form of a quadrant-shaped indentation.

When the climbing cylinder 20 is retracted, the protrusion 42 abuts an upper face 44 of the cylinder tube of the climbing cylinder 20 when viewed in the vertical direction. As a result, the brackets 36*a*, 36*b* are pivoted when the climbing cylinder 20 is retracted (in the view according to FIG. 5, in the clockwise direction). This pivoting action takes place about the rotary pin 38 against the resistance of a spring element 46. By means of this pivoting action, the spacer device 34 is moved from the deactivated position, as shown in FIG. 5, into the activated position.

Figure 6:
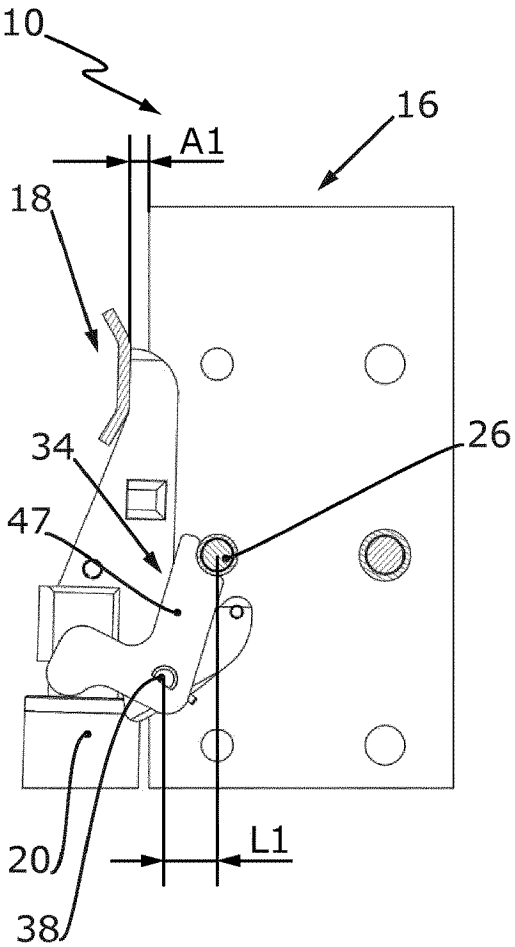
FIG. 6 is a partial side view of the climbing device during extension of the climbing cylinder, with an activated spacer device.

FIG. 6 shows the climbing head 18 of the climbing device 10 having been spaced from the climbing rail 16 by the distance A1 when the climbing cylinder 20 is retracted. The spacer device 34 is in the activated position.

The rotary pin 38 is spaced from the now central projection 26 on the lever arm 47 by the lever length L1. Since the lever length L1 perpendicular to the longitudinal axis of the climbing rail 16 is greater than 0, the climbing head 18 bypasses the central projection 26 when the climbing cylinder 20 is extended.

Figure 7:
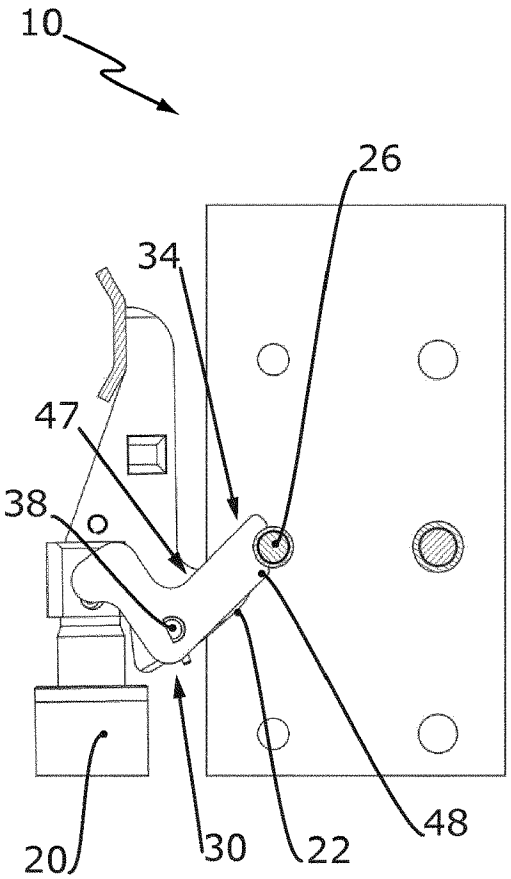
FIG. 7 is a partial side view of the climbing device according to FIG. 6 with a climbing cylinder extended further.

FIG. 7 shows the climbing device 10 with the climbing cylinder 20 extended further. A tab 48 prevents the spacer device 34 from prematurely pivoting back into the deactivated position. The tab 48 rests on the central projection 26 and blocks the lever arm 47 from pivoting back until the rotary pin 38 has definitely passed by the central projection 26 vertically, such that the hook 22 (see also FIG. 5) has also safely passed by the central projection 26. While the climbing cylinder 20 is being extended, the surface pressure between the contact surface 40 (see FIG. 5) and the projection 24, 26, 28, 29 is sufficient to prevent movement of the spacer device 34, in particular to prevent the spacer device 34 from pivoting back. The tab 48 is therefore not strictly necessary in the embodiment shown.

Figure 8:
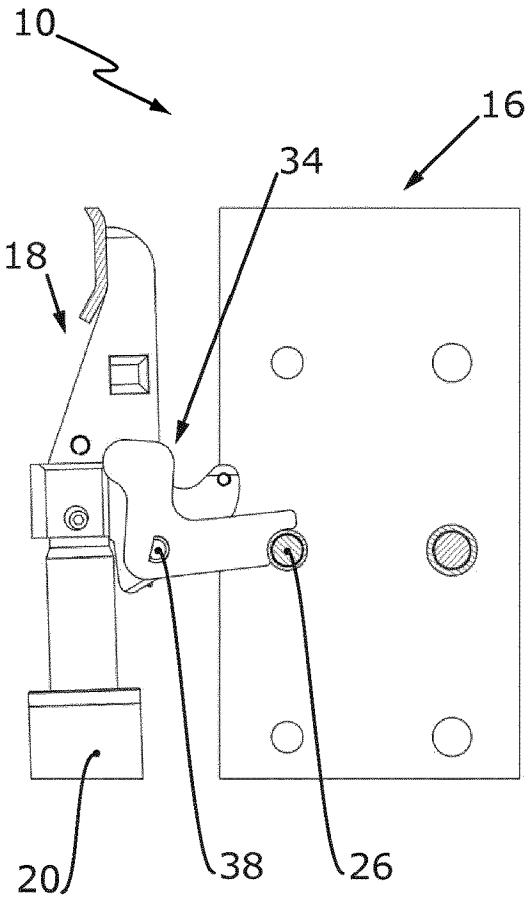
FIG. 8 is a partial side view of the climbing device according to FIG. 7 with a climbing cylinder extended further.

FIG. 8 shows the climbing device 10 when the climbing cylinder 20 is extended further, the spacer device 34 spacing the climbing head 18 further and further from the climbing rail 16 until the rotary pin 38, as shown in FIG. 8, is substantially at the level of the central projection 26.

Figure 9:
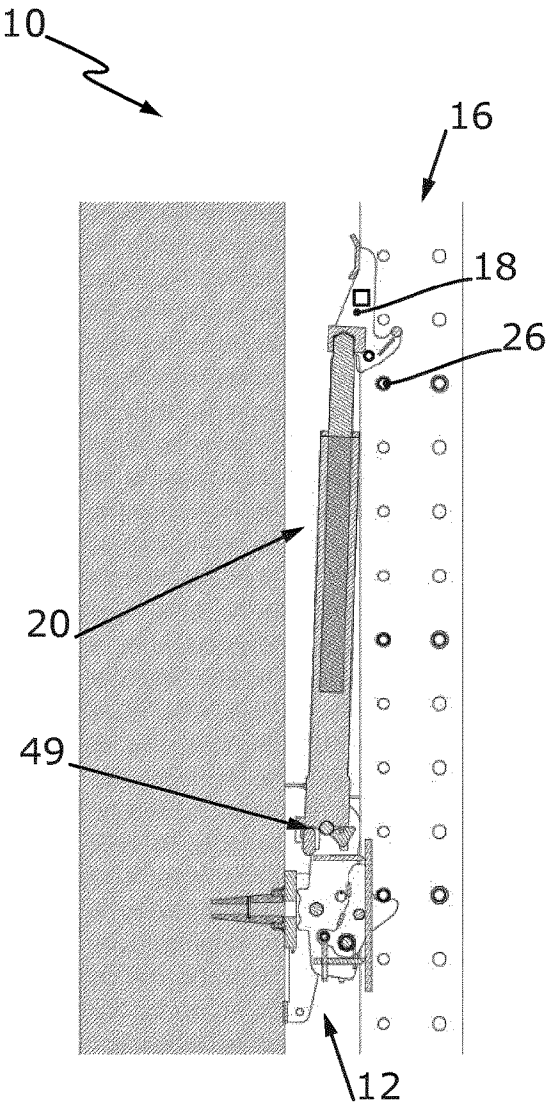
FIG. 9 is a sectional view of the climbing device according to FIG. 8 with a climbing cylinder extended further.

FIG. 9 shows the climbing device 10 with the climbing cylinder 20 extended further. A climbing-cylinder spring element 49 which pivots the climbing cylinder 20 towards the climbing rail 16 is arranged between the climbing cylinder 20 and the climbing shoe 12. When FIGS. 4, 6 to 8 and 9 are considered together, it is clear that the climbing head 18 can bypass the central projection 26 in an arc-shaped manner when the climbing cylinder 20 is extended.

Reference sign 49 in FIG. 9 also denotes an anchoring point of the climbing cylinder 20. In the present case, the anchoring point is formed in the climbing shoe 12, in particular on an upper face of the climbing shoe 12.

FIG. 10 shows the climbing device 10 with the climbing cylinder 20 extended. The spacer device 34 is in the deactivated position. An outer end 50 of the rocker 37 is positioned on the side of the rotary pin 38 that is remote from the upper projection 24. An inner end 52 of the rocker 37 or the protrusion 42 no longer rests on the upper face 44 of the cylinder tube. As a result, the hook 22 of the climbing head 18 can engage under the upper projection 24 in an unimpeded manner. If the climbing cylinder 20 is retracted again following deactivation and subsequent activation of the detent 30 (see FIGS. 2 and 3) of the climbing shoe 12, the climbing rail 16 can be lowered again in another cycle (see FIG. 1 et seq.).

FIGS. 11 and 12 show how the climbing rail 16 can be made to climb upwards manually.

FIG. 11 shows the climbing device 10, with the spacer device 34 being manually pivoted far enough that the outer end 50 of the rocker 37 can engage under the central projection 26. Here, the inner end 52 is spaced from the cylinder head 44 despite the climbing cylinder 20 being retracted. According to the position in FIG. 11, the spacer device 34 has thus been manually deactivated for the climbing rail 16 to be able to climb upwards in an exceptional situation.

FIG. 12 shows how the climbing cylinder 20 of the climbing device 10 is then pivoted towards the climbing rail 16 by the climbing-cylinder spring element 49 (see FIG. 9) while the spacer device 34 is manually held in the position shown, such that the hook 22 engages under the central projection 26 and the extension of the climbing cylinder 20 can cause the climbing rail 16 to be raised.

Figure 13:
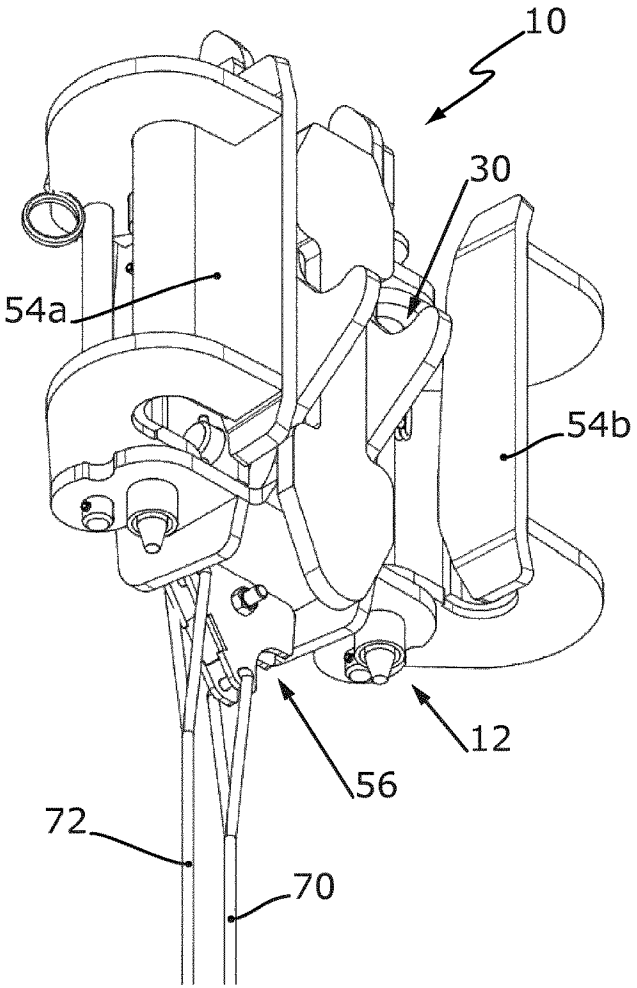
FIG. 13 is an isometric view of the climbing shoe with an extended detent and a blocking device in the released position.

FIG. 13 shows the lower part of the climbing device 10 with the climbing shoe 12. The climbing shoe 12 comprises arms 54*a*, 54*b* for guiding the climbing rail 16 (see FIG. 10). FIG. 13 also shows the extended detent 30, which is in two parts here. A blocking device 56 in the released position allows the detent 30 to extend. The detent 30 is automatically extended by a detent spring element (not shown). This position of the detent 30 is also shown in FIG. 1.

Figure 14:
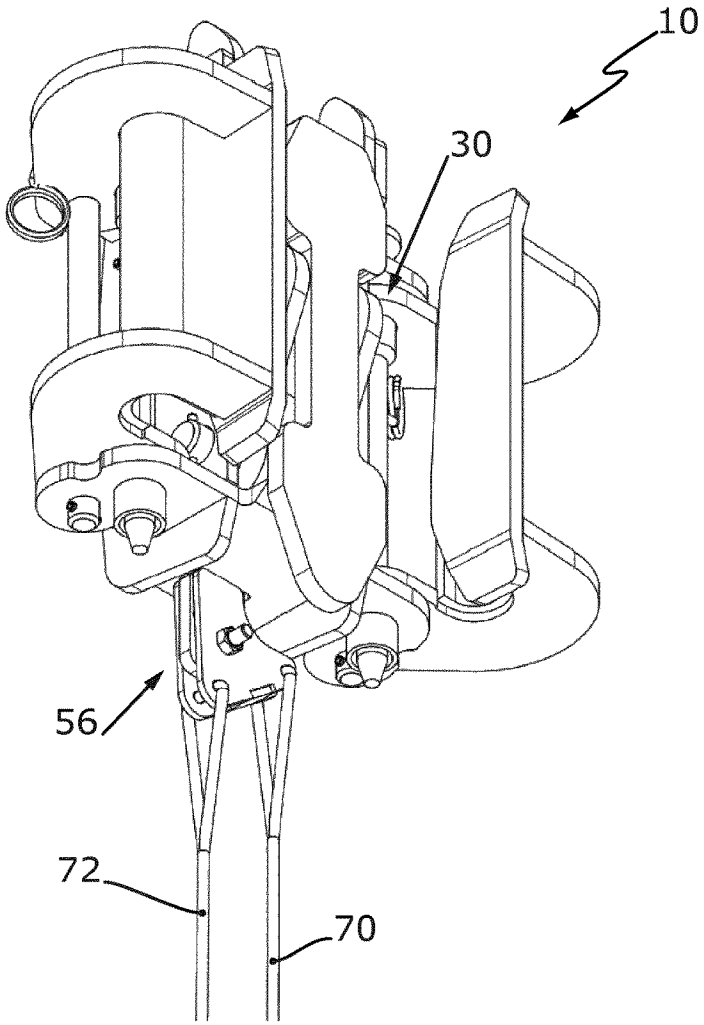
FIG. 14 is an isometric view of the climbing shoe according to FIG. 13 with a retracted detent and the blocking device in the blocking position.

FIG. 14 shows the climbing device 10 with the detent 30 retracted. The blocking device 56 has been moved into the blocking position in this figure. In this blocking position, the detent 30 is blocked from extending. This position of the detent 30 is also shown in FIG. 2. The spring force of the detent spring element (not shown), which is attempting to push the detent 30 outwards, ensures that the blocking device 56 cannot be released by itself, e.g. by vibrations.

Figure 15:
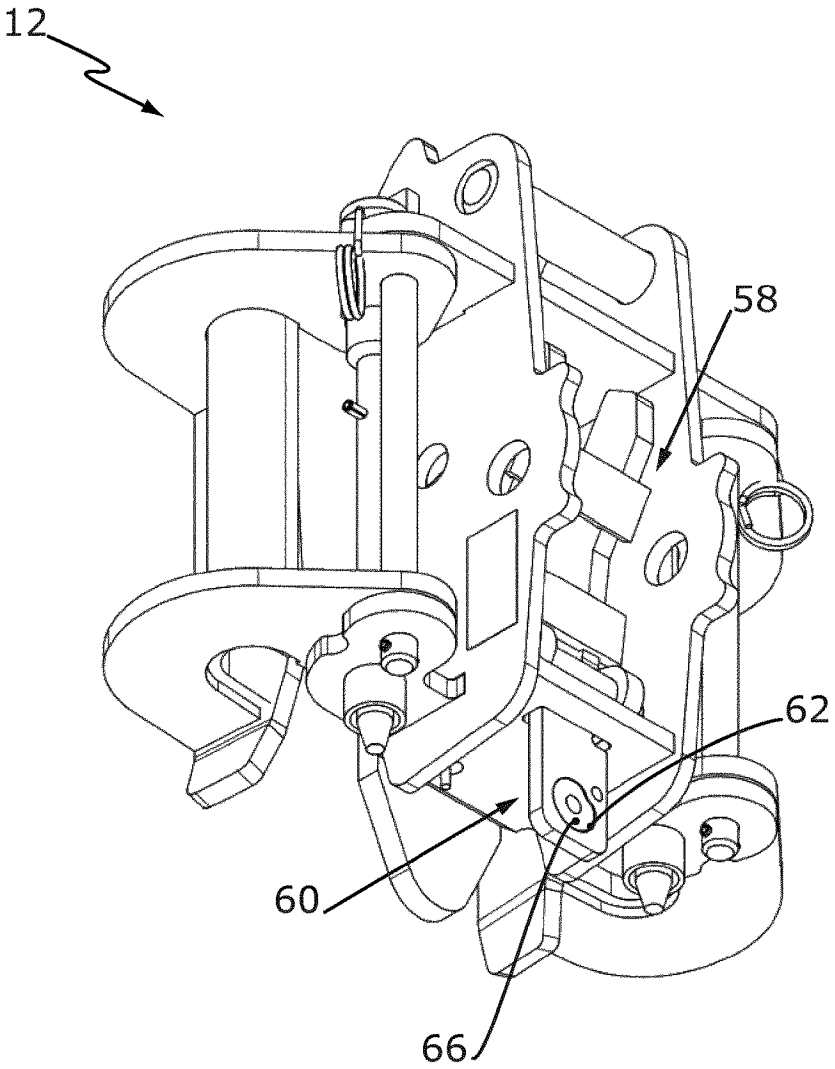
FIG. 15 is an isometric view of the climbing shoe according to FIG. 14 with a retracted detent and the blocking device in the blocking position.

FIG. 15 shows the climbing shoe 12 from the side that is remote from the climbing rail 16 (see FIG. 1). The climbing shoe 12 comprises a deflected portion 58, which connects the detent 30 (see FIG. 13) to a tongue 60. A movement of the tongue 60 causes a movement of the detent 30, by means of the deflected portion 58. The tongue 60 comprises a tongue cut-out 62.

Figure 16:
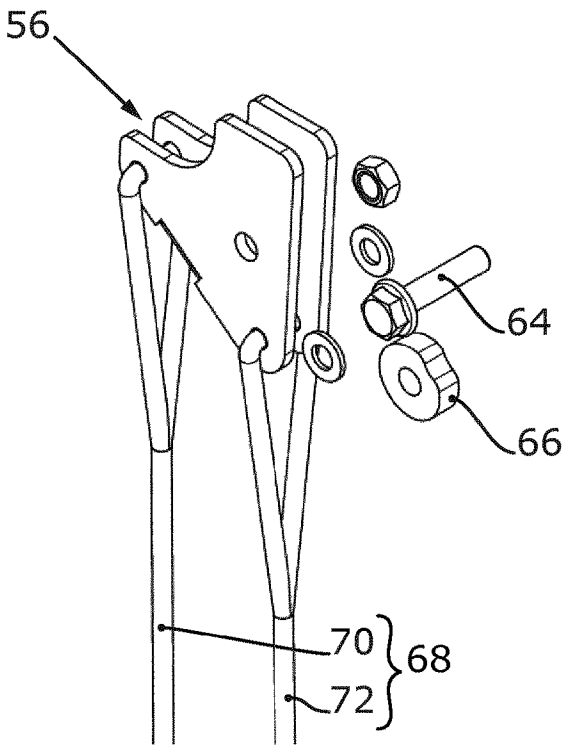
FIG. 16 is an isometric view of the individual parts of the blocking device according to FIGS. 13 and 14.

FIG. 16 shows the blocking device 56. It is clear from FIG. 16 that the blocking device 56 is formed in two parts and is eccentric-shaped. The blocking device 56 is pivotally arranged on the tongue 60 (see FIG. 15) by means of a screw 64, a rivet, a pin or the like. In order for it to be possible to use the existing tongue cut-out 62, a reducer 66 is provided. The inserted reducer 66 is shown in FIG. 15.

An actuating means 68 in the form of two cables 70, 72 is provided on the blocking device 56. The mechanical actuating means 68 makes it possible to remotely actuate the blocking device 56. The cables 70, 72 for controlling the blocking device 56 are accordingly shown in FIGS. 13 and 14.

For reasons of clarity, the blocking device 56 and the actuating means 68 are not shown in FIGS. 1 to 4 and 9.

Figure 17B:
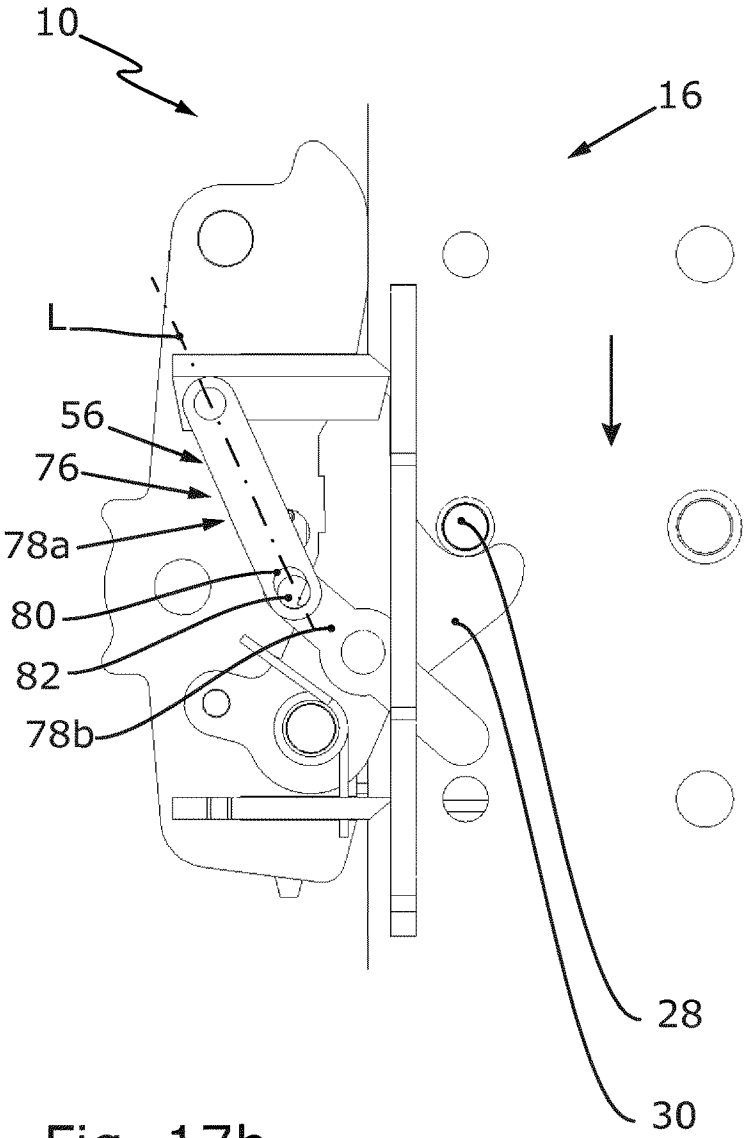
FIG. 17*b* is a partial sectional side view of the climbing shoe according to FIG. 17*a* with the detent in the fully extended position.
Figure 17A:
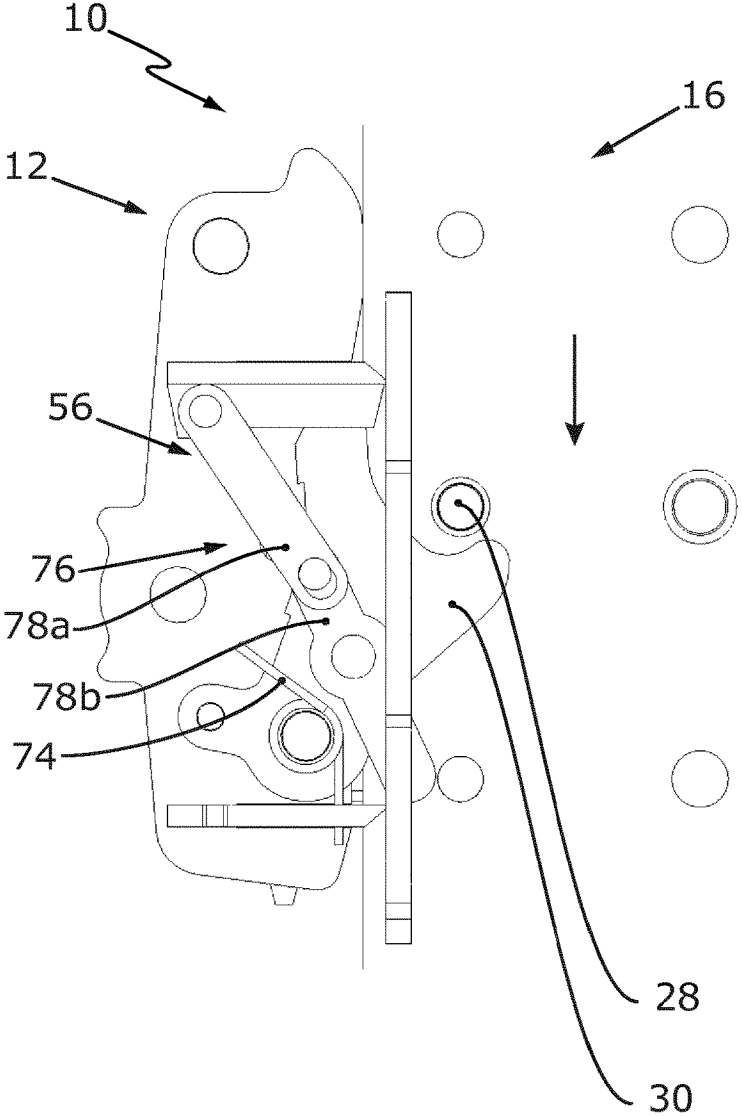
FIG. 17*a* is a partial sectional side view of another climbing shoe with a detent in the almost fully extended position.

FIG. 17*a* shows a climbing device 10 comprising a climbing shoe 12 for guiding a climbing rail 16. The climbing shoe 12 is mounted on a solid wall (not shown) on the side thereof that is remote from the climbing rail 16. A lower projection 28 of the climbing rail 16 is positioned above a detent 30. The detent 30 is urged to retract by a detent spring element 74 under spring force. In FIG. 17*a*, the detent 30 is in the almost fully extended position. A blocking device 56 prevents the detent 30 from retracting. The blocking device 56 comprises a toggle joint 76 comprising articulated arms 78*a*, 78*b*. In the position shown in FIG. 17*a*, the toggle joint 76 is in its compressed position, in which it blocks the detent 30 from extending.

FIG. 17*b* shows the climbing device 10, the weight of the climbing rail 16 being borne by the lower projection 28 on the detent 30. In this position, the detent 30 prevents the climbing rail 16 from being lowered further. By means of the pivoting of the detent 30 into the fully extended position that is shown, the toggle joint 76 is guided out of its blocking compressed position. Here, the articulated arm 78*a* comprises a slot 80, in which a blocking projection 82 of the articulated arm 78*b* is guided with play. The play of the blocking projection 82 is in particular in the longitudinal direction L of the articulated arm 78*a* in this case. The longitudinal direction L of the articulated arm 78*a* extends at an angle or obliquely to the vertical, such that the lower end of the articulated arm 78*a* is urged to move towards the vertical. This is not possible in the compressed position according to FIG. 17*a*. Once the detent 30 is fully extended, as shown in FIG. 17*b*, the lower end of the (upper) articulated arm 78*a* can move towards the vertical and the blocking by the blocking device 56 can be released. The detent 30 could now retract in principle, but is prevented therefrom by the weight of the climbing rail 16.

Figure 17D:
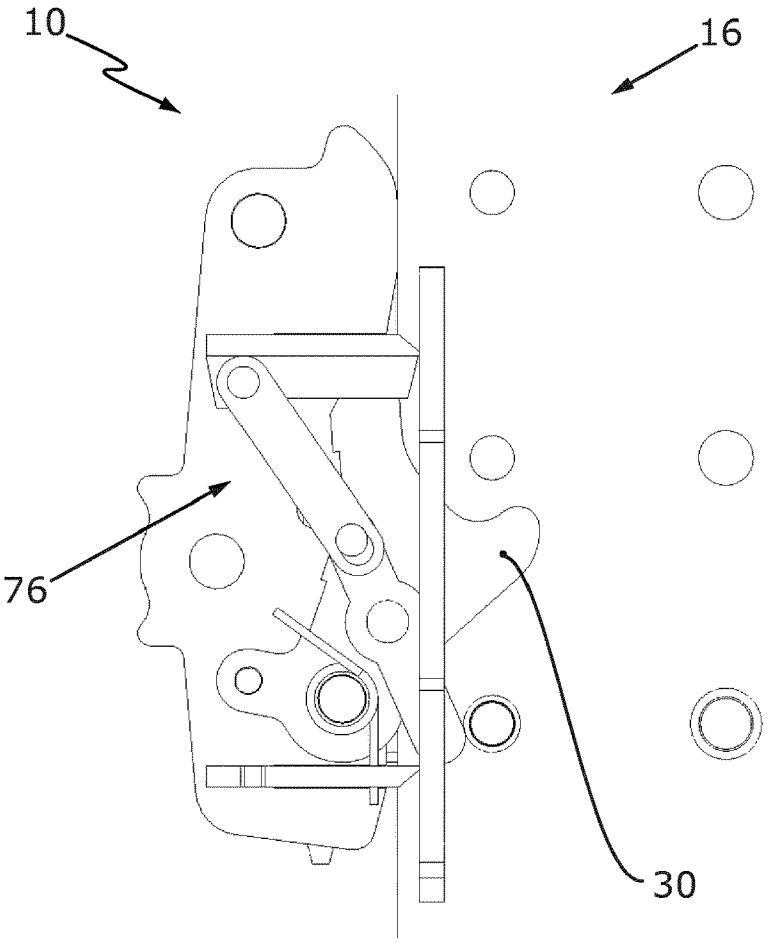
FIG. 17*d* is a partial sectional side view of the climbing shoe according to FIG. 17*c* once the detent has been extended again into the almost fully extended position.
Figure 17C:
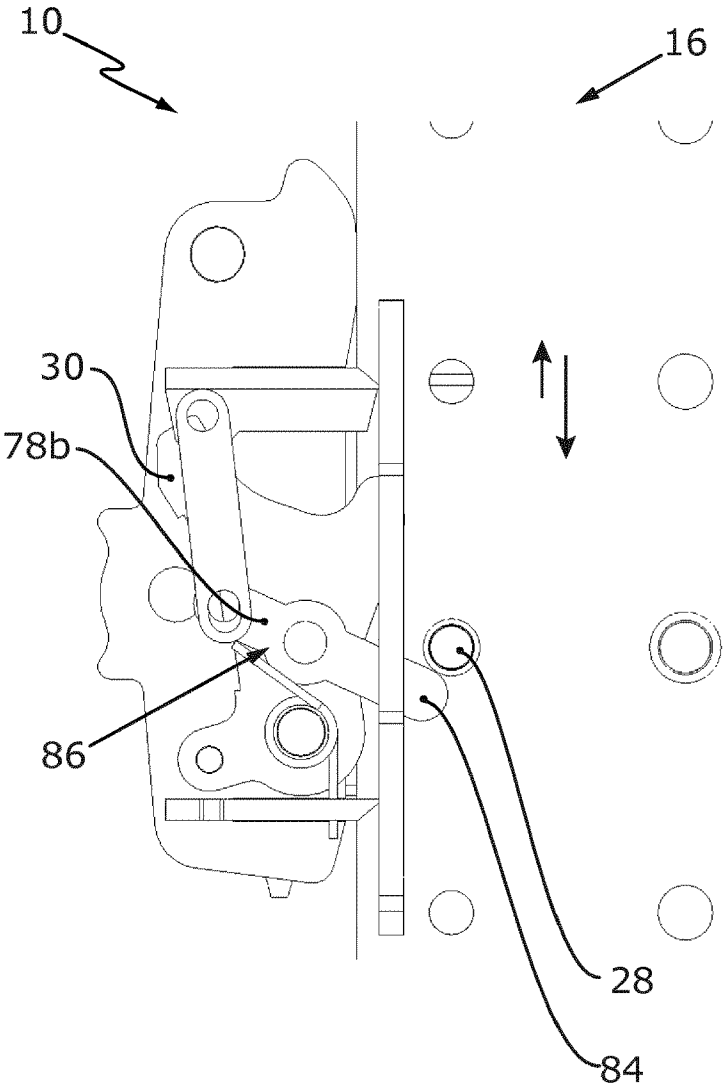
FIG. 17*c* is a partial sectional side view of the climbing shoe according to FIG. 17*b* with the detent in the fully retracted position.

FIG. 17*c* shows the climbing device 10, with the climbing rail 16 having been slightly raised and then lowered such that the detent 30 was able to retract. The climbing rail 16 can thus be made to climb downwards. In the process, the detent 30 is prevented from becoming stuck in the retracted position by means of a lever 84. The lever 84 in particular forms a rocker 86 together with the articulated arm 78*b*. If the lever 84 is actuated downwards by means of the lower projection 28, the detent 30, which is connected to the lever 84, extends again.

FIG. 17*d* shows the climbing device 10 with the detent 30 in the extended position. The toggle joint 76 is once again in the compressed position that blocks the detent 30. The method can then continued again analogously to FIGS. 17*a* to 17*d* in order to further lower the climbing rail 16.

The embodiment of the climbing shoe 12 according to FIG. 17*a*-17*d* thus makes it possible to lower the climbing rail 16 projection by projection, without the climbing shoe 12 needing to be actuated itself.

Figure 18B:
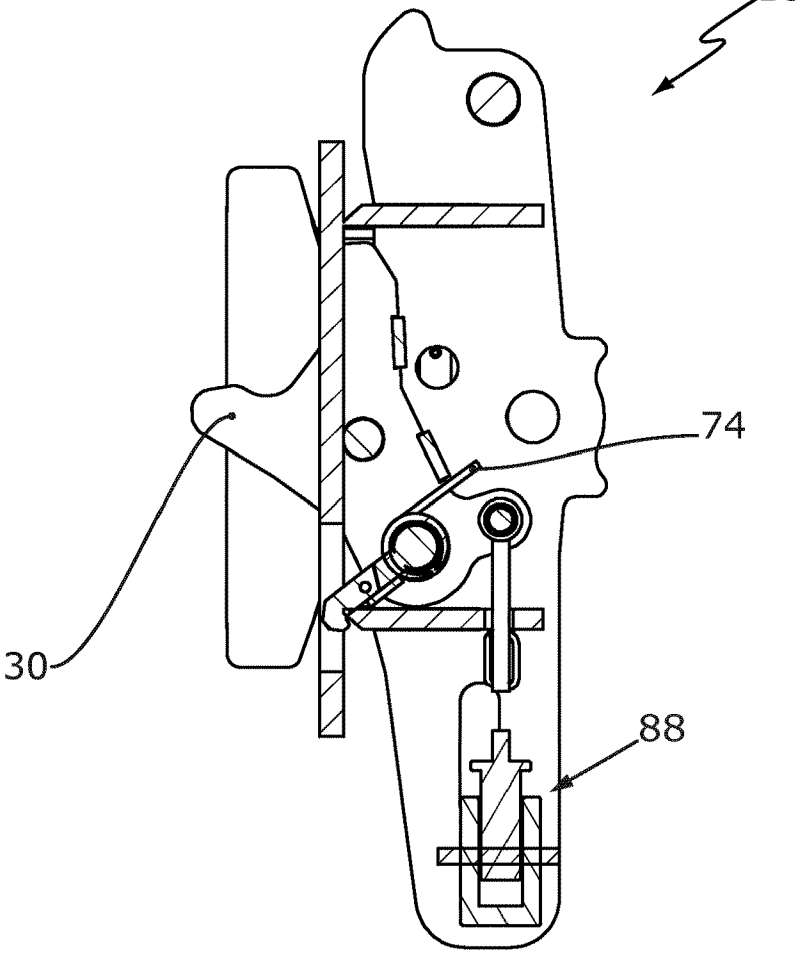
FIG. 18*b* is a partial sectional side view of the climbing shoe according to FIG. 18*a* with a detent in the fully extended position.
Figure 18A:
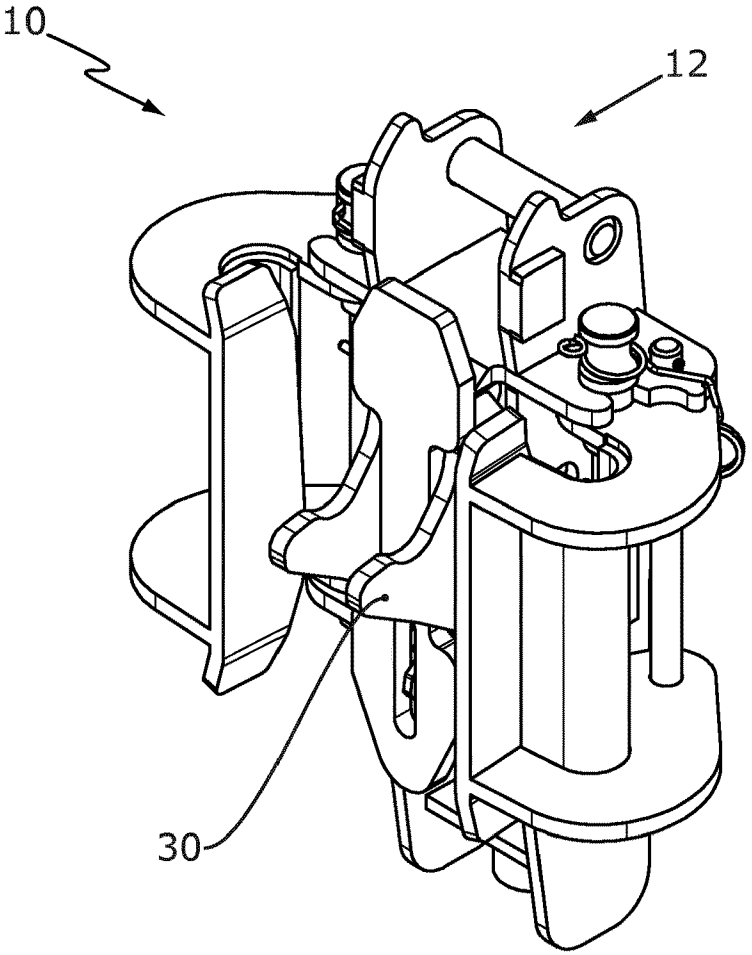
FIG. 18*a* is an isometric view of another climbing shoe.

FIG. 18*a* shows another embodiment of a climbing device 10 comprising a climbing shoe 12. The climbing shoe 12 comprises a retractable and extendable detent 30. The climbing rail is not shown. This is designed as in the embodiment in FIG. 17*a*-17*d*.

FIG. 18*b* shows the climbing device 10 with the detent 30 extended. The detent 30 is connected to a push-push mechanism 88 for controlling the detent 30. a detent spring element 74 urges the detent 30 under spring force in order to extend said detent 30. In the position shown in FIG. 18*b*, the detent 30 thus prevents the climbing rail from being lowered, since the projections of the climbing rail would rest on the detent 30. In order to retract the detent 30, the climbing rail is raised such that a projection of the climbing rail pushes the detent 30 inwards.

Figure 18D:
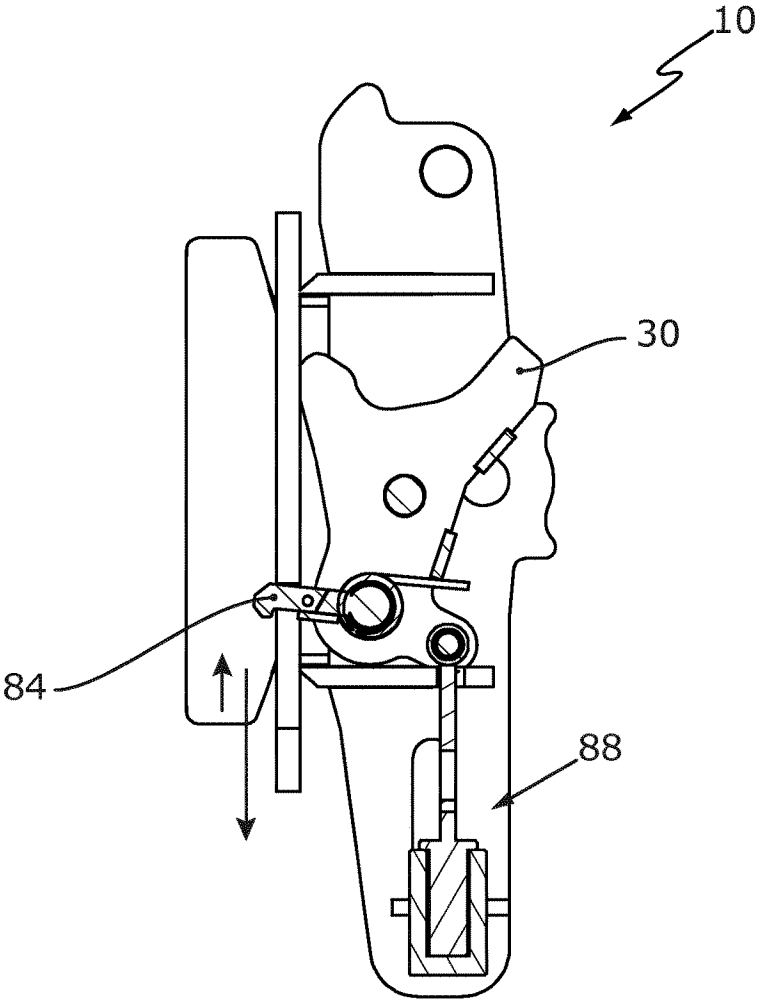
FIG. 18*d* is a partial sectional side view of the climbing shoe according to FIG. 18*c* with the detent in the fully retracted position.
Figure 18C:
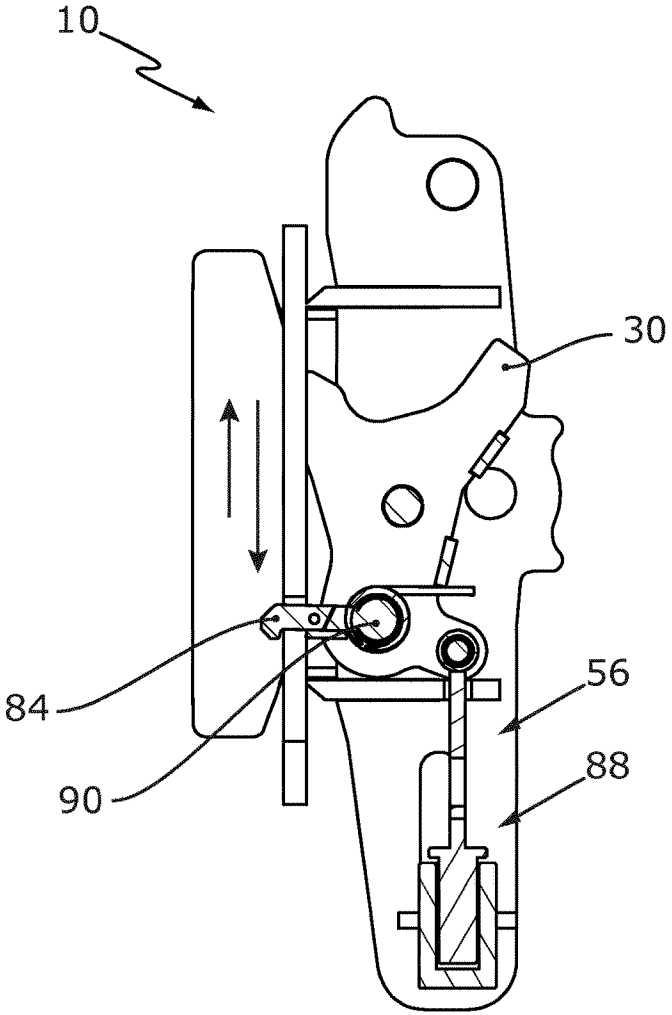
FIG. 18*c* is a partial sectional side view of the climbing shoe according to FIG. 18*b* with a detent in the almost fully retracted position.

FIG. 18*c* shows the fully retracted detent 30 of the climbing device 10. The push-push mechanism 88 holds the detent 30 in the almost fully retracted position. The push-push mechanism 88 thus forms part of a blocking device 56. With the detent 30 almost fully retracted, the climbing rail can be lowered as far as desired. In the process, the projections of the climbing rail pass by a lever 84. The lever 84 is connected to the detent 30 by a freewheel 90, which allows the lever 84 to spring downwards without actuating the detent 30. If the detent 30 is intended to be extended again, the lever 84 can be actuated upwards. This movement is not unblocked by the freewheel 90.

FIG. 18*d* shows the climbing device 10 when the lever 84 is actuated upwards. The push-push mechanism 88 is unlatched by the in particular fully retracted detent 30 and the detent 30 can extend again.

The embodiment of the climbing shoe 12 shown in FIG. 18*a*-18*d* allows a climbing rail to be lowered as far as desired when the detent 30 is being held in the almost fully retracted position by the push-push mechanism 88. Moving the detent spring element 74 from a position in which the detent spring element 74 is attempting to move the detent 30 for the purpose of extension into a position in which the detent spring element 74 is attempting to move the detent 30 for the purpose of retraction does not need to be carried out. Instead, the detent spring element 74 can constantly move the detent 30 for the purpose of extension, meaning that the safety and ease of use of the climbing shoe 12 is increased.

When considering all the figures of the drawings together, in summary the invention relates to a method and to a climbing device 10 for lowering a climbing rail 16, i.e. for making said rail climb downwards. In the method, the climbing rail 16 that rests on a climbing head 18 by an upper projection 24 is lowered by a climbing cylinder 20 being retracted. In particular, before the climbing cylinder 20 is extended again, it can be spaced from the climbing rail 16 at the upper end by means of a spacer device 34 by the climbing cylinder 20 being fully retracted. As a result, the climbing cylinder 20 can be extended again without the climbing rail 16, together with the climbing head 18, engaging or hooking under the now central projection 26, by the spacer device 34 moving the climbing head 18 around the central projection 26. In this process, the spacer device 34 is activated in the retracted position of the climbing cylinder 20 in order to bypass a projection 24, 26, 28, 29 of the climbing rail 16 and is deactivated in the extended position of the climbing cylinder 20 in order to engage under a projection 24, 26, 28, 29 of the climbing rail 16 by means of a hook 22 of the climbing head 18. The climbing cylinder 20 preferably projects at the lower end from a climbing shoe 12, the detent 30 of which can be indirectly or directly released and blocked by means of a mechanical actuating means 68. The detent 30 of the climbing shoe 12 may alternatively or additionally be reversibly detachably held by a blocking device 56 in the form of a toggle joint 76 and/or a push-push mechanism 88. Preferably, lever 84 that can be actuated by a projection 24, 26, 28, 29 is provided in order for the detent 30 to be extended again in a manner actuated by a projection 24, 26, 28, 29.

The invention claimed is:

1. A climbing device for lowering a climbing rail, the climbing device comprising the following:

a) a climbing cylinder, which can be supported at a lower end on an anchoring point, b) a climbing head, which is arranged or formed on an upper end of the climbing cylinder, an upper projection of the climbing rail capable of being supported on the climbing head;

wherein the climbing device comprises the following:

c) a spacer device, which i. is activated when the climbing cylinder is retracted in order to move the climbing head away from the climbing rail when the climbing cylinder is extended such that the climbing head can fit to a central projection of the climbing rail and ii. is deactivated when the climbing cylinder is extended such that the climbing head can engage under the upper projection when the climbing cylinder is extended, wherein the spacer device is designed to be pushed away from the central projection of the climbing rail when the climbing cylinder is extended.

2. The climbing device according to claim 1, wherein the spacer device is designed to be activated when the climbing cylinder is retracted, in order to move the climbing head away from the central projection when the climbing cylinder is subsequently extended.

3. The climbing device according to claim 1, wherein the spacer device is arranged on the climbing head.

4. The climbing device according to claim 1, wherein the spacer device comprises a pivotable rocker.

5. The climbing device according to claim 4, wherein the rocker can pivot outwards at a lower end when the climbing cylinder retracts by the rocker pivoting from an inwardly pivoted position into an outwardly pivoted position and the spacer device being activated thereby.

6. The climbing device according to claim 1, wherein the climbing device comprises a climbing shoe that can be mounted on a solid wall to guide the climbing rail, the climbing shoe comprising a detent on which a lower projection of the climbing rail can be supported, the detent being movable from an extended position in which the lower projection can be supported on the detent into a retracted position in which the lower projection cannot be supported on the detent, the climbing device comprising a blocking device designed to hold the detent in the retracted position.

7. The climbing device according to claim 6, wherein the climbing device comprises a mechanical actuating means that is longer than 1 m in order to adjust the blocking device.

8. The climbing device according to claim 6, wherein the climbing cylinder is pivotally arranged at the lower end on the anchoring point.

9. The climbing device according to claim 7, wherein the mechanical actuating means is in the form of a mechanical traction means.

10. The climbing device according to claim 6, wherein the climbing shoe comprises a tongue and a deflected portion, the tongue being extended and retracted by means of the deflected portion when the detent retracts and extends, the blocking device being designed to block the movement of the tongue.

11. The climbing device according to claim 6, wherein the blocking device is in the form of an eccentric, the eccentric capable of being releasably locked in a blocking position and the detent being prevented from extending in the blocking position.

12. The climbing device according to claim 6, wherein, for unlocking the blocking device, the blocking device comprises a lever that is arranged on the climbing shoe below the contact surface of the detent for the projections of the climbing rail.

13. The climbing device according to claim 12, wherein the blocking device comprises a toggle joint that is blocked in a compressed position when the detent is almost fully extended in order to hold the detent in the almost fully extended position, it being possible to release the blocking of the toggle joint by loading when the climbing rail comes to rest on the detent by means of a projection of the climbing rail by the toggle joint being moved into its elongated position, and it being possible to bring about the blocking of the toggle joint by actuating the lever by means of a projection of the climbing rail.

14. The climbing device according to claim 13, wherein an articulated arm of the toggle joint comprises a slot in which a blocking projection on an additional articulated arm of the toggle joint is guided.

15. The climbing device according to claim 13, wherein an articulated arm of the toggle joint is in the form of a rocker, which comprises a lever at one end and is connected to an additional articulated arm of the toggle joint at the other end.

16. The climbing device according to claim 13, wherein an articulated arm is arranged such that its longitudinal axis (L) deviates from the vertical and/or is spring-loaded, in order to move into the released position of the toggle joint when the detent is fully extended.

17. The climbing device according to claim 6, wherein the blocking device comprises a push-push mechanism that is connected to the detent, holds the detent in an almost fully retracted position during a first retraction, and is released into the fully retracted position by a lever during a second retraction, such that the detent extends.

18. The climbing device according to claim 17, wherein the blocking device comprises a spring-loaded freewheel, by means of which the lever is connected to the detent, the freewheel not transferring actuation of the lever downwards to the detent by means of a projection of the climbing rail, but transferring actuation of the lever upwards to the detent.

19. The climbing device according to claim 1, wherein the climbing device comprises the climbing rail.

20. A method for lowering a climbing rail using a climbing device according to claim 1, wherein the method further comprises:

B) extending the climbing cylinder and, in the process, moving the climbing head away from the climbing rail by means of the activated spacer device.

21. The method according to claim 20, wherein the method comprises:

A) supporting the climbing rail on a detent of the climbing shoe by means of its lower projection;

B) extending the climbing cylinder and, in the process, moving the climbing head away from the central projection of the climbing rail by means of the activated spacer device;

C) deactivating the spacer device and raising the climbing rail by engagement under the upper projection of the climbing rail;

D) retracting the detent;

E) retracting the climbing cylinder and thereby lowering the climbing rail;

F) extending the detent and lowering the climbing rail by means of the lower projection on the detent.

22. The method according to claim 21, wherein the retraction of the detent during one of retraction of the detent during step D), and/or the extension of the detent during step F) is carried out by actuating an actuating means.

23. The method according to claim 21, wherein the detent is extended by actuating a lever.

24. The method according to claim 23, wherein the detent is held in an almost fully extended position by a toggle joint and lowering the climbing rail onto the detent releases the toggle joint.

25. The method according to claim 23, wherein the detent is held in an almost fully retracted position by a push-push mechanism during retraction, and the detent being actuated again by the lever releases a blocking of the push-push mechanism and fully extends the detent.

26. A climbing device for lowering a climbing rail, the climbing device comprising:

a climbing cylinder having an upper end and a lower end, the climbing cylinder configured to be supported at the lower end by an anchoring point;

a climbing head arranged or formed on the upper and of the climbing cylinder, the climbing head configured to support an upper projection of the climbing rail;

a spacer device configured to be:

activated when the climbing cylinder is retracted in order to move the climbing head away from the climbing rail when the climbing cylinder is extended such that the climbing head can engage with a central projection of the climbing rail, and deactivated and pushed away from the central projection when the climbing cylinder is extended such that the climbing head can engage the upper projection when the climbing cylinder is extended.

* * * * *